US011802703B2

(12) United States Patent
Brahme et al.

(10) Patent No.: US 11,802,703 B2
(45) Date of Patent: Oct. 31, 2023

(54) AUTOMATIC STAGING OF MULTIPLE HVAC SYSTEMS DURING A PEAK DEMAND RESPONSE

(71) Applicant: Lennox Industries Inc., Richardson, TX (US)

(72) Inventors: Rohini Brahme, Irving, TX (US); Chao Xia, Frisco, TX (US); Pete Hrejsa, Frisco, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 17/575,499

(22) Filed: Jan. 13, 2022

(65) Prior Publication Data

US 2023/0221028 A1 Jul. 13, 2023

(51) Int. Cl.

| | |
|---|---|
| ***F24F 11/46*** | (2018.01) |
| ***F24F 11/56*** | (2018.01) |
| ***F24F 11/64*** | (2018.01) |
| ***F24F 11/61*** | (2018.01) |
| *F24F 120/20* | (2018.01) |
| *F24F 110/10* | (2018.01) |
| *F24F 120/10* | (2018.01) |
| *F24F 140/60* | (2018.01) |

(52) U.S. Cl.

CPC ..... *F24F 11/46* (2018.01); *F24F 11/56* (2018.01); *F24F 11/61* (2018.01); *F24F 11/64* (2018.01); *F24F 2110/10* (2018.01); *F24F 2120/10* (2018.01); *F24F 2120/20* (2018.01); *F24F 2140/60* (2018.01)

(58) Field of Classification Search

CPC .. F24F 11/46; F24F 11/56; F24F 11/61; F24F 11/64; F24F 2110/10; F24F 2120/10; F24F 2120/20; F24F 2140/60; F24F 11/30; F24F 11/006; G05B 15/02

See application file for complete search history.

(56) References Cited

U.S. PATENT DOCUMENTS

| | | | | |
|---|---|---|---|---|
| 10,612,804 | B2 | 4/2020 | Brahme et al. | |
| 10,612,808 | B2 | 4/2020 | Joy et al. | |
| 10,830,474 | B2 | 11/2020 | Brahme et al. | |
| 11,067,305 | B2 | 7/2021 | Brahme et al. | |
| 2004/0182941 | A1* | 9/2004 | Alles | F24F 13/10 236/51 |
| 2015/0369847 | A1* | 12/2015 | Roosli | F24F 11/63 702/61 |

(Continued)

FOREIGN PATENT DOCUMENTS

EP 1944558 A1 * 7/2008 ..... F24F 11/30

*Primary Examiner* — Alicia M. Choi

(74) *Attorney, Agent, or Firm* — Baker Botts L.L.P.

(57) ABSTRACT

A system includes multiple HVAC systems. After receiving a demand request, a multiple-system controller determines a first anticipated power consumption associated with operating a first HVAC system at a first temperature setpoint during a future period of time of the demand response request and a second anticipated power consumption associated with operating a second HVAC system at a second temperature setpoint during the future period of time. Based at least in part on the first and the second anticipated power consumptions, a staging schedule is determined that indicates when to operate the first and second HVAC systems.

20 Claims, 4 Drawing Sheets

(56) References Cited

U.S. PATENT DOCUMENTS

| | | | | |
|---|---|---|---|---|
| 2016/0091904 | A1* | 3/2016 | Horesh | F24F 11/58 700/276 |
| 2016/0196622 | A1* | 7/2016 | Tokunaga | G06Q 50/06 705/7.25 |
| 2018/0209678 | A1* | 7/2018 | Ferrari | F24F 11/65 |
| 2018/0246483 | A1* | 8/2018 | Belgera | H04Q 9/00 |
| 2019/0353382 | A1* | 11/2019 | Atchison | F24F 11/61 |
| 2021/0003308 | A1* | 1/2021 | Venne | G06N 20/00 |
| 2021/0339607 | A1* | 11/2021 | Kaiser | F25B 41/22 |
| 2023/0125880 | A1* | 4/2023 | Analytis | F24F 11/523 236/1 C |

* cited by examiner

AUTOMATIC STAGING OF MULTIPLE HVAC SYSTEMS DURING A PEAK DEMAND RESPONSE

TECHNICAL FIELD

This disclosure relates generally to heating, ventilation, and air conditioning systems. More particularly, in certain embodiments, this disclosure relates to automatic staging of multiple HVAC systems during a peak demand response.

BACKGROUND

Heating, ventilation, and air conditioning (HVAC) systems are used to regulate environmental conditions within an enclosed space. Air is cooled via heat transfer with refrigerant flowing through the HVAC system and returned to the enclosed space as conditioned air.

SUMMARY OF THE DISCLOSURE

In some cases, HVAC systems may be required to operate under restricted operating requirements to reduce power consumption during times of peak electricity demand and/or decreased electricity supply, referred to in this disclosure as peak demand response times or demand response times. For example, a third party such as a utility provider may enforce certain operating restrictions upon HVAC systems during peak demand response times. A peak demand response time may correspond, for example, to a time period associated with high outdoor temperatures or any other time when electrical power consumption is expected (e.g., based on a forecast or projection) to be increased. Generally, the third party (e.g., a utility provider) provides a request, referred to herein as a demand response, which specifies an upper limit on power consumption by an HVAC system during a peak demand response time. In some cases, the demand request may be provided via an electronic signal.

The system of this disclosure solves problems of previous HVAC systems by facilitating improved comfort during peak demand response times by intelligently staging operations of multiple HVAC systems more efficiently and effectively than was previously possible. For example, when instructions for operating at decreased energy consumption are received as part of a demand response, an efficient staging of multiple HVAC systems is determined that improves user comfort during the time period of the demand response. In certain embodiments, the systems and methods described in this disclosure may be integrated into a practical application of a multiple system controller that improves system performance and occupant comfort during peak demand response times by more effectively and efficiently staging operations of the multiple HVAC systems. Certain embodiments may include none, some, or all of the above technical advantages. One or more other technical advantages may be readily apparent to one skilled in the art from the figures, descriptions, and claims included herein.

In an embodiment, a system includes a first HVAC system configured to regulate a first temperature of a first space based on a first temperature setpoint. The system includes a second HVAC system configured to regulate a second temperature of a second space based on a second temperature setpoint. A multiple-system controller is communicatively coupled to the first HVAC system and the second HVAC system. The multiple system controller stores enrollment data indicating which HVAC systems are participating in automatic demand response operation. A demand response request is received indicating an upper limit on combined power consumption by the first and second HVAC systems during a future period of time. Based on the enrollment data, the controller determines that both the first HVAC system and the second HVAC system are participating in automatic demand response operation. A first anticipated power consumption is determined associated with operating the first HVAC system at the first temperature setpoint during the future period of time of the demand response request. A second anticipated power consumption is determined associated with operating the second HVAC system at the second temperature setpoint during the future period of time of the demand response request. Based at least in part on the first anticipated power consumption and the second anticipated power consumption, a staging schedule is determined that indicates a first portion of the future period of time of the demand response request during which the first HVAC system is turned off and the second HVAC system is turned on and a second portion of the future period of time of the demand response request during which the first HVAC system is turned on and the second HVAC system is turned off. The controller causes first HVAC system and the second HVAC system to operate according to the determined staging schedule (e.g., by turning compressors of the first and second HVAC systems on and off at times indicated by the staging schedule).

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

As described above, prior to the present disclosure, there was a lack of tools for improving comfort in a conditioned space in response to a demand response (i.e., a request for decreased HVAC energy consumption). This disclosure recognizes that temperature in a space (e.g., a home, office, or other building) that is serviced by multiple HVAC systems can be maintained at more comfortable levels than was formerly achieved by more efficiently and effectively staging the operations of the multiple HVAC systems. In this way, one or more HVAC systems may be turned off during a portion of a demand response time, while another HVAC system (e.g., or multiple other HVAC systems, in some cases) are turned on during this portion of time. In this way, effective cooling (or heating) is still provided during the peak demand response time, while still satisfying the energy-saving requirements of the demand response. Turning off an HVAC system corresponds to stopping, or preventing, operation of a compressor or heating element of the HVAC system, such that the HVAC system does not provide cooling or heating to a corresponding space and such that the energy consumption of the HVAC system is negligible. Likewise, turning on an HVAC system corresponds to starting, or allowing, operation of a compressor or heating element of the HVAC system, such that the HVAC system provides cooling or heating to the corresponding space. For example, when an HVAC system is turned on, the HVAC system may provide cooling or heating based on a predefined setpoint temperature.

Control System for Multiple HVAC Systems

Figure 1:
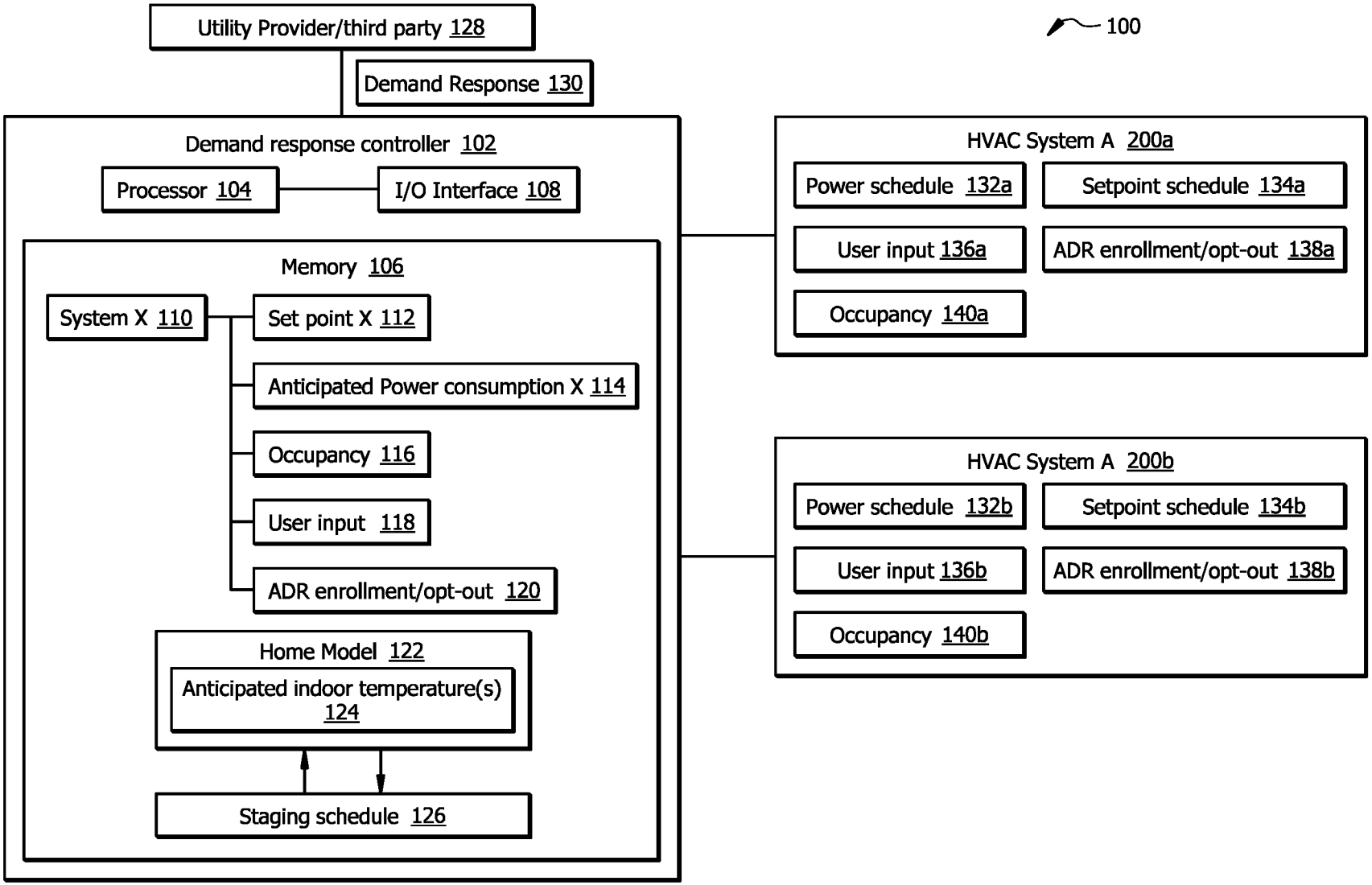
FIG. 1 is a diagram of an example system configured for improved operation of multiple HVAC systems during peak demand response times.

FIG. 1 shows an example system 100 for controlling multiple HVAC systems 200*a,b* in response to a demand response 130. The system 100 facilitates improved operation of HVAC systems 200*a,b* that condition different portions of a space during peak demand response times, such that user comfort can be maintained while still achieving the decrease in energy consumption indicated by the demand response 130. A demand response 130 generally indicates an upper limit on combined power consumption by the HVAC systems 200*a,b* during a future period of time (e.g., demand response time 302 of FIGS. 3A and 3B). As described further below, the demand response controller 102 of system 100 determines anticipated power consumptions 114 of the HVAC systems 200*a,b*, and uses the anticipated power consumptions 114 to determine a staging schedule 126 for operating the HVAC systems 200*a,b*.

The system 100 includes the demand response controller 102, a utility provider or other third party 128, and two or more HVAC systems 200*a,b* that condition air in different spaces (e.g., different rooms or portions of a home, building, or the like), each of which is described in further detail below.

Multi-System Demand Response Controller

The demand response controller 102 receives a demand response 130 from utility provider/third party 128. The demand response 130 is a request indicating an upper limit on power consumption by the HVAC systems 200*a,b* during a future period of time, referred to herein as a peak demand response time (e.g., time period 302 of FIGS. 3A and 3B described in greater detail below). The future period of time may be a time during which power production by the utility provider 128 is not projected to meet demand. For example, the future period of time may be a time with severe weather conditions (e.g., excessively high or low temperatures).

The demand response controller 102 determines which of the HVAC systems 200*a,b* are participating in automatic demand response (ADR) operation. For example, ADR enrollment/opt-out data 120 that indicates participating HVAC systems 110 (e.g., all or a portion of the HVAC systems 200*a,b*) may be used for this purpose. The demand response controller 102 then determines, for each participating HVAC system 110, an anticipated power consumption 114 for operating the HVAC system 110 at a temperature setpoint 112 (e.g., corresponding to current or scheduled setpoint 134*a,b* of the corresponding HVAC system 200*a,b*). For example, the anticipated power consumption 114 may be determined based on a predefined relationship between the setpoint 112 and outdoor temperature. In some cases, this relationship may be specific to the HVAC system 110 (e.g., a first HVAC system 200*a* may have a different anticipated power consumption 114 than a second HVAC system 200*b* for the same temperature setpoint 112).

Figure 3A:
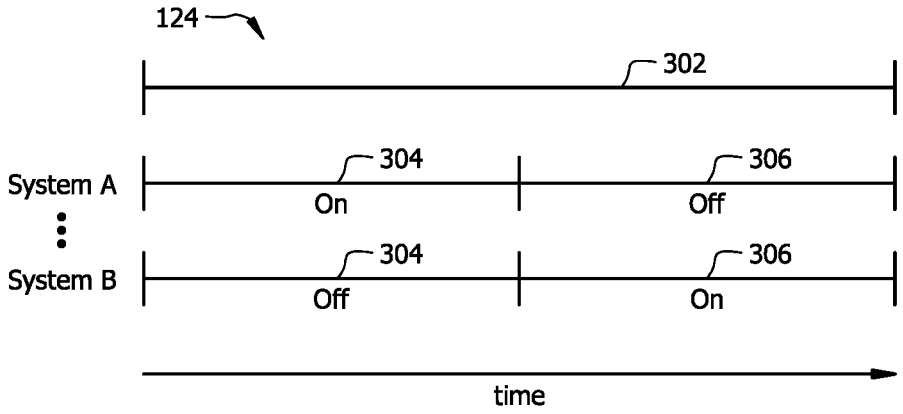
FIGS. 3A and 3B are diagrams illustrating example staging schedules that are determined and automatically implemented for peak demand response times by the system of FIG. 1.
Figure 3B:
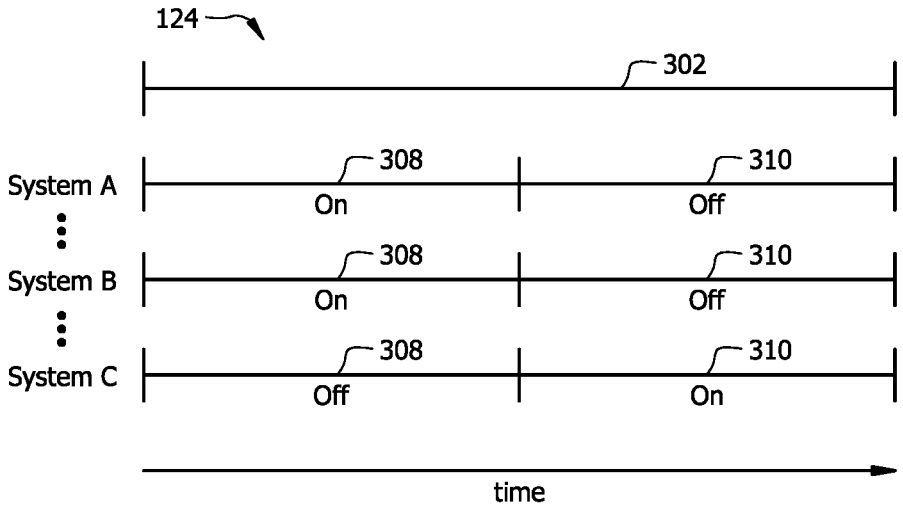

The anticipated power consumption 114 for each participating HVAC system 110 is then used to determine a staging schedule 126 for operating the participating HVAC systems 110. The staging schedule 126 indicates the distribution of on and off times of HVAC systems 110 over the time interval of the demand response 130. For example, the staging schedule 126 may indicate period of times during the demand response time during which the participating HVAC systems 110 are either on or off. In some cases, the staging schedule 126 may indicate energy-saving setpoints 112 at which to operate one or more of the HVAC systems 110. For example, an HVAC system 110 servicing (e.g., cooling or heating) an occupied space may be "setback" to a high temperature for cooling mode operation or a lower temperature for heating mode operation. FIGS. 3A and 3B, which are described below, illustrate example staging schedules 126 for different example scenarios. Once the staging schedule 126 is determined, the demand response controller 102 causes the participating HVAC systems 110 to operate according to the staging schedule 126. For example, the staging schedule 126 may be provided to the participating HVAC systems 200*a,b* and used to update the power schedule 132*a,b* for the HVAC systems 200*a,b*.

In some embodiments, the staging schedule 126 may be determined, or adjusted, based at least in part on occupancy 116 of the spaces serviced by the participating HVAC systems 200*a,b*. For the example of two participating HVAC systems 110 that include first HVAC system 200*a* and second HVAC system 200*b*, a first occupancy 140*a* may be determined for a first space for which air is conditioned by first HVAC system 200*a*. A second occupancy 140*b* may be determined for a second space for which air is conditioned by second HVAC system 200*b*. Occupancies 140*a,b* may be "occupied" if one or more people are in the space or "unoccupied" if no one is in the space. An occupancy sensor (e.g., sensor 234 of FIG. 2) may be used to determine the occupancies 140*a,b*. If the space serviced by any of the HVAC systems 110 is unoccupied (or becomes unoccupied during the demand response time), the staging schedule 126 may be adjusted to cause that HVAC system 110 to shut off at least when its serviced space is unoccupied.

In some embodiments, a user input 118 may be received and used to adjust whether a given HVAC system 110 is participating in ADR operation (e.g., to adjust the ADR enrollment/opt-out data 120. For example, a user input 118 (e.g., a user input 136*a,b*, received for a corresponding HVAC system 200*a,b*) may indicate that the first HVAC system 200*a* is opted out of ADR operation. After receiving such a user input 118, any times of the staging schedule 126 may be removed during which the first HVAC system 200*a* would have been required to be turned off In order to still satisfy the energy consumption reduction required by the demand response 130, the period of time during which the second HVAC system 200*b* is turned off in the staging schedule 126 may be increased. A user input 118 may be received as user input 136*a*, for example, via a thermostat (e.g., thermostat/controller 236 of FIG. 2) associated with the HVAC system 200*a,b*.

In some embodiments, the demand response controller 102 determines the staging schedule 126 based at least in part on a home model 122. A home model 122 generally allows anticipated indoor temperature(s) 124 to be determined for spaces serviced by HVAC systems 110 for a given staging schedule 126. In other words, the home model 122 allows a staging schedule 126 to be proactively "tested" and refined to further improve occupant comfort via determination of anticipated indoor temperature(s) 124. Examples of home models 122 and their development are described in U.S. Pat. No. 10,612,804, entitled "Operating an HVAC system to reach target temperature efficiently"; U.S. Pat. No. 10,612,808, entitled "Operating an HVAC system based on predicted indoor air temperature"; U.S. Pat. No. 10,830,474, entitled "Systems and methods of predicting energy usage"; and U.S. Pat. No. 11,067,305, entitled "Method and system for heating auto-setback", each of which is incorporated herein in its entirety.

As an example, a home model 122 may be generated over time using information about the operation of HVAC systems 110. For example, the power history 244 and temperature history 246 of HVAC systems 200*a,b* of FIG. 2 may be used to generate the home model 122 and subsequently predict anticipated indoor temperatures 124 for a given staging schedule 126. The home model 122 may indicate anticipated indoor temperature 124 as a function of run time (e.g., as indicated in staging schedule 126) for each HVAC system 110. One or more rounds of iteration 128 (illustrated by the arrows in FIG. 1) may be used to adjust the staging schedule 126 to maintain the anticipated indoor temperature(s) 124 in a target range. In this way, the home model 122 may further improve occupant comfort within spaces serviced by HVAC systems 200*a,b*.

The demand response controller 102 includes a processor 104, memory 106, and input/output (I/O) interface 108. The processor 104 comprises one or more processors operably coupled to the memory 106. The processor 104 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 106 and controls the operation of HVAC system 200*a,b*. The processor 104 may be a programmable logic device, a microcontroller, a microprocessor, or any suitable combination of the preceding. The processor 104 is communicatively coupled to and in signal communication with the memory 106. The one or more processors are configured to process data and may be implemented in hardware or software. For example, the processor 104 may be 8-bit, 16-bit, 32-bit, 64-bit or of any other suitable architecture. The processor 102 may include an arithmetic logic unit (ALU) for performing arithmetic and logic operations, processor registers that supply operands to the ALU and store the results of ALU operations, and a control unit that fetches instructions from memory 106 and executes them by directing the coordinated operations of the ALU, registers, and other components. The processor may include other hardware and software that operates to process information, control the HVAC systems 200*a,b*, and perform any of the functions described herein (e.g., with respect to FIG. 4). The processor 104 is not limited to a single processing device and may encompass multiple processing devices.

The memory 106 comprises one or more disks, tape drives, or solid-state drives, and may be used as an over-flow data storage device, to store programs when such programs are selected for execution, and to store instructions and data that are read during program execution. The memory 106 may be volatile or non-volatile and may comprise ROM, RAM, ternary content-addressable memory (TCAM), dynamic random-access memory (DRAM), and static random-access memory (SRAM). The memory 106 is operable to store any suitable set of instructions, logic, rules, and/or code for executing the functions described in this disclosure with respect to FIGS. 1-4. The memory 106 may store for each HVAC system 110 (e.g., corresponding to HVAC systems 200*a,b* of system 100), a temperature setpoint 112 (e.g., a current or upcoming value from the system's setpoint schedule 134*a,b*), an anticipated power consumption 114 (e.g., determined as described elsewhere in this disclosure), an occupancy 116 (e.g., occupancies 140*a,b* of HVAC systems 200*a,b*), a user input 118 (e.g., a user input 136*a,b* of HVAC systems 200*a,b*), and ADR enrollment/opt-out data (e.g., based on ADR enrolment/opt-out statuses 138*a,b* of HVAC systems 200*a,b*).

The I/O interface 108 is configured to communicate data and signals with other devices. For example, the I/O interface 108 may be configured to communicate electrical signals with the HVAC systems 200*a,b* and/or the components of the HVAC systems 200*a,b*. The I/O interface 108 may send signals that cause the staging schedule 126 to be implemented by the HVAC systems 200*a,b*. The I/O interface 108 may use any suitable type communication protocol. The I/O interface 108 may comprise ports and/or terminals for establishing signal communications between the thermostat/controller 236 of each HVAC system 200*a,b* and other devices. The I/O interface 108 may be configured to enable wired and/or wireless communications.

Utility Provider

The utility provider or third party 128 is generally an entity tasked with overseeing and/or regulating energy consumption by HVAC systems 200*a,b*. For example, a utility provider or third party 128 may be a company or organization that distributes energy to homes and businesses. In situations in which energy demand is anticipated to exceed supply, a demand response 130 may be transmitted to HVAC systems 200*a,b* and/or to demand response controller 102. As described above, the demand response 130 indicates a prescribed reduction in energy consumption (e.g., a percent reduction in energy consumption from a baseline or average value) or a maximum energy consumption (e.g., a maximum permitted energy consumption per time) during the future period of time during which a decrease in energy consumption is needed.

HVAC Systems

The system 100 includes at least two HVAC systems 200*a,b*. For clarity and conciseness only two HVAC systems, first HVAC system 200*a* and second HVAC system 200*b*, are illustrated in FIG. 1. However, the system 100 could include three or more HVAC systems 200*a,b*. Each HVAC system 200*a,b* provides conditioned air (e.g., "services") a corresponding portion of a space. For example, the first HVAC system 200*a* may provide conditioned air to a portion of a room or rooms in a home or other building, and the second HVAC system 200*b* may provide conditioned air to other room or rooms in the same home or building. Each HVAC system 200*a,b* is associated with a power schedule 132*a,b* which indicates times when the HVAC system 200*a,b* will be turned on (e.g., allowed to provide cooling or heating) and turned off (e.g., not allowed to provide cooling or heating). Turning off an HVAC system 200*a,b* generally corresponds to turning off or not powering a compressor 206 or heating element of the system 200*a,b* (see FIG. 2 and corresponding description below).

Each HVAC system 200*a,b* may be associated with a temperature setpoint schedule 134*a,b* indicating target temperatures that the HVAC system 200*a,b* will attempt to reach in the future. Each HVAC system 200*a,b* may be operable to receive a user input 136*a,b* (e.g., via thermostat/controller 236 of FIG. 2) indicating whether a user wishes for the HVAC system 200*a,b* to participate in ADR operation. User inputs 136*a,b* may be provided to demand response controller 102 and stored as user inputs 118. In other cases, user inputs 118 may be received via a user interface of the demand response controller 102 itself or any other appropriate device. Each HVAC system 200*a,b* may be associated with an ADR enrollment/opt-out status 138*a,b*. The ADR enrollment/opt-out status 138*a,b* may be provided to the demand response controller 102 to establish the ADR enrollment/opt-out data 120, described above. In other cases, the ADR enrollment/opt-out data 120 may be received via a user interface of the demand response controller 102 itself or any other device. Each HVAC system 200*a,b* may be associated with an occupancy 140*a,b* (e.g., determined by an occupancy sensor 234 of FIG. 2). The occupancy 140*a,b* may be provided to the demand response controller 102 to establish the occupancies 116, described above. In other cases, the occupancy 140*a,b* may be received via a user interface of the demand response controller 102 itself or any other device.

Figure 2:
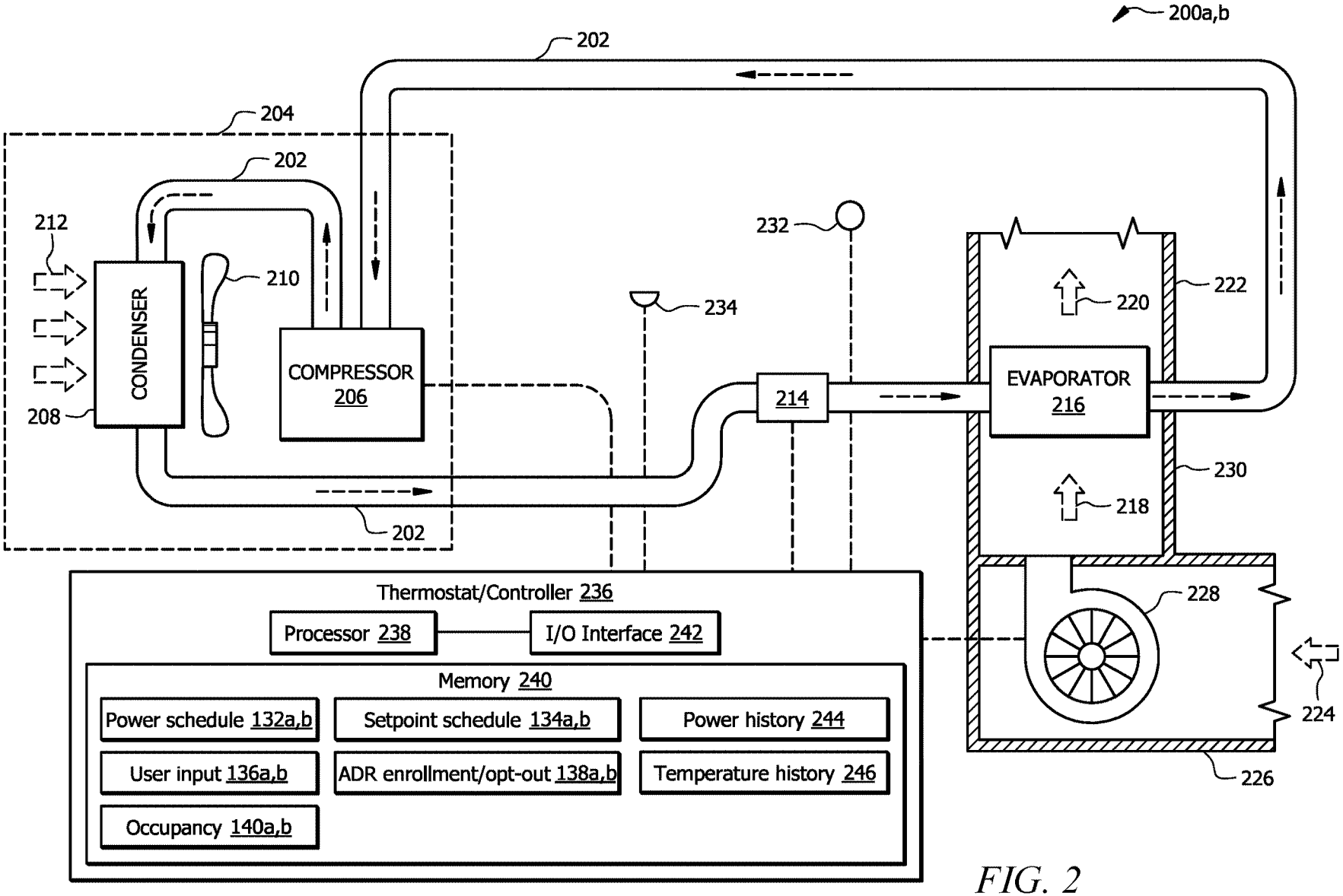
FIG. 2 is a diagram of an example HVAC system from the system of FIG. 1.

FIG. 2 shows an example HVAC system 200*a,b* of FIG. 1 in greater detail. The HVAC system 200*a,b* conditions air for delivery to a portion of a conditioned space. As described above with respect to FIG. 1, the space conditioned by each HVAC system 200*a,b* may be a portion of a room, a house, an office building, a warehouse, or the like. In some embodiments, the HVAC system 200*a,b* is a rooftop unit (RTU) that is positioned on the roof of a building and the conditioned air is delivered to the interior of the building. In other embodiments, portion(s) of the system 200*a,b* may be located within the building and portion(s) outside the building. The HVAC system 200*a,b* may include one or more heating elements, not shown for convenience and clarity. The HVAC system 200*a,b* may be configured as shown in FIG. 2 or in any other suitable configuration. For example, the HVAC system 200*a,b* may include additional components or may omit one or more components shown in FIG. 2.

The HVAC system 200*a,b* includes a working-fluid conduit subsystem 202, at least one condensing unit 204, an expansion valve 214, an evaporator 216, a blower 228, and one or more thermostats/controllers 236. The working-fluid conduit subsystem 202 facilitates the movement of a working fluid (e.g., a refrigerant) through a cooling cycle such that the working fluid flows as illustrated by the dashed arrows in FIG. 2. The working fluid may be any acceptable working fluid including, but not limited to hydrofluorocarbons (e.g. R-410A) or any other suitable type of refrigerant.

The condensing unit 204 includes a compressor 206, a condenser 208, and a fan 210. In some embodiments, the condensing unit 204 is an outdoor unit while other components of system 200*a,b* may be located indoors. The compressor 206 is coupled to the working-fluid conduit subsystem 202 and compresses (i.e., increases the pressure of) the working fluid. In most embodiments, the compressor 206 is a single-stage compressor. However, more generally, the compressor 206 of condensing unit 204 could be a variable-speed compressor or a multi-stage compressor. A variable-speed compressor is generally configured to operate at different speeds to increase the pressure of the working fluid to keep the working fluid moving along the working-fluid conduit subsystem 202. In the multi-stage compressor configuration, one or more compressors can be turned on or off to adjust the cooling capacity of the HVAC system 200*a,b*. The staging schedule 126 can include instructions for adjusting the speed of a variable-speed compressor and/or turning on and off stages of a multi-stage compressor.

The compressor 206 is in signal communication with the thermostat/controller 236 and/or the demand response controller 102 using wired and/or wireless connection. The thermostat/controller 236 and/or the demand response controller 102 provide commands and/or signals to control operation of the compressor 206 and/or receive signals from the compressor 206 corresponding to a status of the compressor 206. For example, the thermostat/controller 236 and/or the demand response controller 102 may provide signals to turn the compressor 206 on or off based on the staging schedule 126 of FIG. 1.

The condenser 208 is configured to facilitate movement of the working fluid through the working-fluid conduit subsystem 202. The condenser 208 is generally located downstream of the compressor 206 and is configured to remove heat from the working fluid. The fan 210 is configured to move air 212 across the condenser 208. For example, the fan 210 may be configured to blow outside air through the condenser 208 to help cool the working fluid flowing therethrough. The fan 210 may be in communication with the thermostat/controller 236 and/or the demand response controller 102 (e.g., via wired and/or wireless communication) to receive control signals for turning the fan 210 on and off and/or adjusting a speed of the fan 210. The compressed, cooled working fluid flows from the condenser 208 toward the expansion valve 214.

The expansion valve 214 is coupled to the working-fluid conduit subsystem 202 downstream of the condenser 208 and is configured to remove pressure from the working fluid. In this way, the working fluid is delivered to the evaporator 216. In general, the expansion valve 214 may be a valve such as an expansion valve or a flow control valve (e.g., a thermostatic expansion valve (TXV)) or any other suitable valve for removing pressure from the working fluid while, optionally, providing control of the rate of flow of the working fluid. The expansion valve 214 may be in communication with the thermostat/controller 236 and/or the demand response controller 102 (e.g., via wired and/or wireless communication) to receive control signals for opening and/or closing associated valves and/or to provide flow measurement signals corresponding to the rate of working fluid flow through the working-fluid conduit subsystem 202.

The evaporator 216 is generally any heat exchanger configured to provide heat transfer between air flowing through (or across) the evaporator 216 (i.e., air 218 contacting an outer surface of one or more coils of the evaporator 216) and working fluid passing through the interior of the evaporator 216. The evaporator 216 may include one or more circuits of coils. The evaporator 216 is fluidically connected to the compressor 206, such that working fluid generally flows from the evaporator 216 to the condensing unit 204 when the HVAC system 200*a,b* is operating to provide cooling.

A portion of the HVAC system 200*a,b* is configured to move airflow 218 provided by the blower 228 across the evaporator 216 and out of the duct subsystem 222 as conditioned airflow 220. Return air 224, which may be air returning from the building, fresh air from outside, or some combination, is pulled into a return duct 226. A suction side of the blower 228 pulls the return air 224. The blower 228 discharges airflow 218 into a duct 230 such that airflow 218 crosses the evaporator 216 or heating elements (not shown) to produce conditioned airflow 220. The blower 228 is any mechanism for providing airflow 218 through the HVAC system 200*a,b*. For example, the blower 228 may be a constant-speed or variable-speed circulation blower or fan. Examples of a variable-speed blower include, but are not limited to, belt-drive blowers controlled by inverters, direct-drive blowers with electronic commuted motors (ECM), or any other suitable type of blower.

The HVAC system 200*a,b* includes one or more sensors 232, 234 in signal communication with thermostat/controller 236 and/or the demand response controller 102 (e.g., via wired and/or wireless connection). Sensor 232 is positioned and configured to measure an indoor air temperature. Sensor 234 is positioned and configured to measure an occupancy 140*a,b* of the space serviced by the HVAC system 200*a,b*. For example, an occupancy sensor 234 may be a motion sensor or the like. In some cases, occupancy 140*a,b* may be determined using known positions of occupants of the space. For example, geofencing may be used to determine occupancy based on the locations of a mobile devices operated by occupants of the space. The HVAC system 200*a,b* may include one or more further sensors (not shown for conciseness), such as sensors for measuring air humidity and/or any other properties of a conditioned space (e.g. a room of the conditioned space). Sensors may be positioned anywhere within the conditioned space, the HVAC system 200*a,b*, and/or the surrounding environment.

The thermostat/controller 236 may include an integrated or separated thermostat and controller. The thermostat may be located within the conditioned space (e.g. a room or building) serviced by the HVAC system 200*a,b*, while the controller may be located elsewhere in some cases. The thermostat/controller 236 is configured to allow a user to input a desired temperature or temperature setpoint 134*a,b* for the conditioned space. In some embodiments, the thermostat/controller 236 includes a user interface and display for displaying information related to the operation and/or status of the HVAC system 200*a,b*. For example, the user interface may display operational, diagnostic, and/or status messages and provide a visual interface that allows at least one of an installer, a user, a support entity, and a service provider to perform actions with respect to the HVAC system 200*a,b*. For example, the user interface may provide for display of messages related to the status and/or operation of the HVAC system 200*a,b* (e.g., whether the HVAC system 200*a,b* is being operated according to a staging schedule 126 determined by the demand response controller 102 of FIG. 1). The user interface may be operable to receive a user input 136*a,b*, described in greater detail above with respect to FIG. 1. The thermostat/controller 236 may further be configured to monitor and store (e.g., in memory 240) a power history 244 and temperature history 246 for the HVAC system 200*a,b*. The power history 244 is a historical log of the power consumed by the HVAC system 200*a,b* in order to achieve indoor temperatures of the temperature history 246. The power history 244 and temperature history 246 may be used to generate the home model 122 described with respect to FIG. 1 above.

The thermostat/controller 236 may include a processor 238, memory 240 and input/output (I/O) interface 242, which may be similar to the processor 104, memory 106, and I/O interface 108 described above with respect to FIG. 1. The memory 240 stores power history 244, temperature history 246, power schedule 132*a,b*, setpoint schedule 134*a,b*, user input 136*a,b*, ADR enrollment/opt-out status 138*a,b*, occupancy 140*a,b*, and any other instructions, logic, rules, and/or code for controlling operation of the HVAC system 200*a,b*. The I/O interface 242 facilitates communication between the thermostat/controller 236 and both the components of the HVAC system 200*a,b* and the demand response controller 102 of FIG. 2. In some embodiments, one or more functions of the thermostat/controller 236 are performed by the demand response controller 102 (or vice versa).

Referring to both FIGS. 1 and 2, connections between various components of the HVAC system 200*a,b* and between components of system 100 may be wired or wireless. For example, conventional cable and contacts may be used to couple the thermostat/controller 236 to the demand response controller 102 and various components of the HVAC system 200*a,b*, including, the compressor 206, the expansion valve 214, the blower 228, and sensor(s) 232, 234. In some embodiments, a wireless connection is employed to provide at least some of the connections between components of the HVAC system 200*a,b*. In some embodiments, a data bus couples various components of the HVAC system 200*a,b* together such that data is communicated there between. In a typical embodiment, the data bus may include, for example, any combination of hardware, software embedded in a computer readable medium, or encoded logic incorporated in hardware or otherwise stored (e.g., firmware) to couple components of HVAC system 200*a,b* to each other.

As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the thermostat/controller 236 to other components of the HVAC system 200*a,b* and/or to the demand response controller 102 of FIG. 1.

Returning to FIG. 1, in an example operation of the system 100, both HVAC systems 200*a,b* are initially turned on and allowed to provide cooling or heating to corresponding portions of a space. A demand response 130 is then received indicating that a decrease in energy consumption is needed during an upcoming period of time. Two example scenarios for determining a staging schedule are described below.

In a first scenario, the demand response controller 102 determines a staging schedule 126 in which operation is staggered between the first HVAC system 200*a* and the second HVAC system 200*b*. If a temperature setpoint is not specified by the demand response 130, the HVAC systems 200*a,b*, when turned on may continue to operate at their current temperature setpoint 134*a,b*, such that occupant comfort is improved over previous approaches to demand response operation. FIG. 3A illustrates an example of such a staging schedule 126 for a future time period, referred to as demand response time 302. During a first portion 304 of the demand response time 302, the first HVAC system 200*a* (referred to as "System A" in FIG. 3A) is turned on and the second HVAC system 200*b* (referred to as "System B" in FIG. 3A) is turned off. Meanwhile, during a second portion 306 of the demand response time 302, System A is turned off and System B is turned on. This example staging schedule 126 improves user comfort in the spaces conditioned by systems A and B by allowing both HVAC systems 200*a,b* to operate for at least some time at a temperature setpoint that enhances occupant comfort during the demand response time 302.

FIG. 3B illustrates an example staging schedule 126 for an example system 100 with an additional HVAC system C (not shown in FIG. 1). In this example Systems A and B have half the cooling/heating capacity of System C. During a first portion 308 of the demand response time 302, the System A and System B are turned on and System C is turned off. Meanwhile, during a second portion 310 of the demand response time 302, System A and System B are turned off and System C is turned on. This example staging schedule 126 improves user comfort in the spaces conditioned by systems A, B, C by intelligently distributing operation based on power consumption/cooling capacity of the various HVAC systems 200*a,b* (Systems A, B, and C in this example).

The example staging schedules 126 of FIGS. 3A and 3B are examples only. Other staging schedules may be determined and implemented to improve occupant comfort while still satisfying energy consumption requirements of a given demand request 130.

Example Method of Operation

Figure 4:
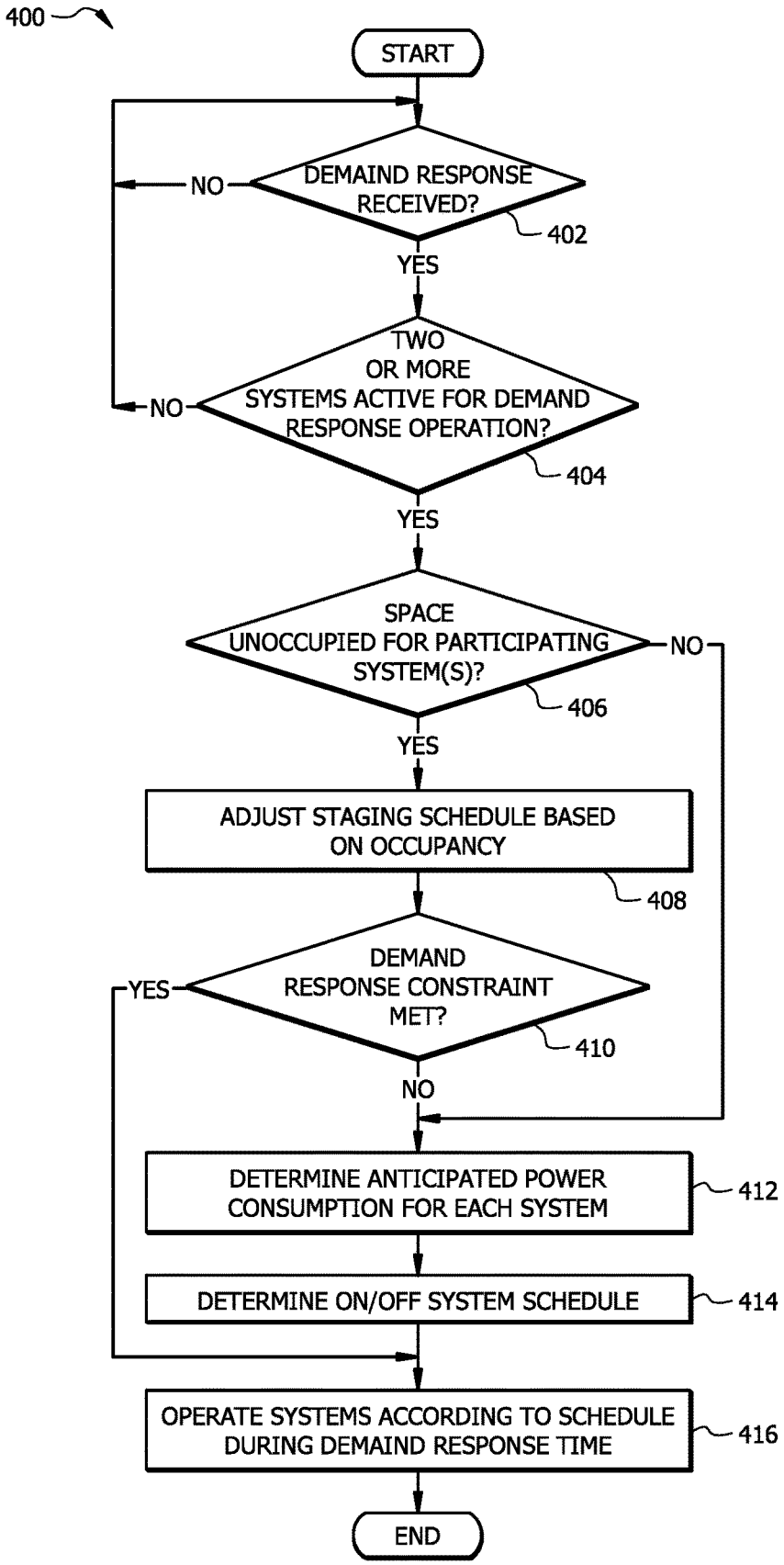
FIG. 4 is a flowchart of an example method of operating the system of FIG. 1.

FIG. 4 is a flowchart of an example method 400 of operating the system of FIG. 1. Steps of method 400 may be implemented using the processor 104, memory 106, and I/O interface 108 of the demand response controller 102. In some cases one or more steps may be performed by other components of the system 100 (e.g., by the thermostat/controller 236 of one or more of the HVAC systems 200*a,b*). Method 400 may begin at step 402 where it is determined whether a demand response 130 has been received. After a demand response 130 is received at step 402, the demand response controller 102 proceeds to step 404.

At step 404, the demand response controller 102 determines whether two or more of the HVAC systems 200*a,b* are participating in ADR operation (e.g., based on the enrollment/opt-out data 120 described above with respect to FIG. 1). If one or none of the HVAC systems 200*a,b* are participating in ADR operation, the demand response controller 102 may return to start and await receipt of another demand response 130 by which time additional HVAC system(s) 200*a,b* may be participating in ADR operation. If two or more of the HVAC systems 200*a,b* are participating in ADR operation, the demand response controller 102 proceeds to step 406.

At step 406, the demand response controller 102 determines whether the occupancies 116 indicate that any of the spaces conditioned by the participating HVAC systems 200*a,b* are unoccupied. If none of the spaces are unoccupied, the demand response controller 102 proceeds to step 412. However, if one or more spaces are unoccupied, the demand response controller 102 adjusts the staging schedule 126 based on occupancies 116 at step 408 (e.g., by scheduling to turn off the HVAC system(s) 200*a,b* servicing the unoccupied space(s) or set these HVAC systems 200*a,b* back to setpoints 112 that will result in little or no operation of these HVAC systems 200*a,b*).

At step 410, the demand response controller 102 determines whether this adjustment is sufficient to meet the energy saving requirements of the demand response 130 (e.g., to consume less than a predefined peak demand energy value). If this is the case, the demand response controller 102 may proceed to step 416 and operate the HVAC systems 200*a,b* according to the staging schedule 126 without necessarily requiring the HVAC system(s) 200*a,b* servicing the occupied space(s) to be turned off during a specified portion of the demand response time. However, if further energy savings is needed to satisfy the energy savings requirements of the demand response 130, the demand response controller 102 proceeds to step 412.

At step 412, the demand response controller 102 determines the anticipated power consumption 114 for each participating HVAC system 200*a,b* that services an occupied space, as described in greater detail with respect to FIG. 1 above. At step 414, the demand response controller 102 uses the anticipated power consumption 114 to determine the staging schedule 126. The staging schedule 126 indicates portions of time during which each participating HVAC system 200*a,b* is turned on and turned off in order to satisfy energy saving requirements of the demand response 130 while improving occupant comfort. In some cases, steps 412 and 414 may be determined through an iterative process using a home model 122, as described with respect to FIG. 1 above.

At step 416, the demand response controller 102 operates the participating HVAC systems 200*a,b* according to the staging schedule 126. The demand response controller 102 causes the participating HVAC systems 200*a,b* to turn off and on during the different periods of time determined at step 414.

Modifications, additions, or omissions may be made to method 400 depicted in FIG. 4. Method 400 may include more, fewer, or other steps. For example, steps may be performed in parallel or in any suitable order. While at times discussed as the demand response controller 102 performing the steps, any suitable components (e.g., a thermostat/controller 236 of FIG. 2) of the system 100 may perform one or more steps of the method.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A system comprising:

a first heating, ventilation, and air conditioning (HVAC) system configured to regulate a first temperature of a first space based on a first temperature setpoint;

a second HVAC system configured to regulate a second temperature of a second space based on a second temperature setpoint, wherein the second HVAC system is different from the first HVAC system; and a multiple-system controller communicatively coupled to the first HVAC system and the second HVAC system, the multiple system controller comprising:

a memory configured to store enrollment data indicating which HVAC systems are participating in an automatic demand response operation; and a processor communicatively coupled to the memory and configured to:

receive a demand response request indicating an upper limit on combined power consumption by the first and second HVAC systems during a future period of time;

determine, based on the enrollment data, that both the first HVAC system and the second HVAC system are participating in the automatic demand response operation;

determine a first anticipated power consumption associated with operating the first HVAC system at the first temperature setpoint during the future period of time of the demand response request;

determine a second anticipated power consumption associated with operating the second HVAC system at the second temperature setpoint during the future period of time of the demand response request;

determine, based at least in part on the first anticipated power consumption and the second anticipated power consumption, a staging schedule indicating:

a first portion of the future period of time of the demand response request during which the first HVAC system is turned off and the second HVAC system is turned on, and a second portion of the future period of time of the demand response request during which the first HVAC system is turned on and the second HVAC system is turned off; and operate the first HVAC system and the second HVAC system according to the determined staging schedule.

2. The system of claim 1, wherein the processor is further configured to:

determine a first occupancy of the first space;

determine a second occupancy of the second space;

determine, based on the first occupancy and the second occupancy, that the first space is unoccupied and the second space is occupied; and in response to determining that that the first space is unoccupied and the second space is occupied:

cause the first HVAC system to shut off during the future period of time of the demand response request; and adjust the staging schedule to increase the first portion of the future period of time during which the second HVAC system is turned on.

3. The system of claim 2, wherein:

the first HVAC system comprises a first occupancy sensor configured to detect the first occupancy of the first space; and the second HVAC system comprises a second occupancy sensor configured to detect the second occupancy of the second space.

4. The system of claim 1, wherein the processor is further configured to:

receive a user input indicating that the first HVAC system is opted out of the automatic demand response;

after receiving the user input, adjust the staging schedule to:

remove the first portion of the future period of time during which the first HVAC system is turned off; and increase the second portion of the future period of time during which the second HVAC system is turned off.

5. The system of claim 4, wherein the first HVAC system comprises a first thermostat configured to:

receive the user input; and transmit the user input to the multiple-system controller.

6. The system of claim 1, wherein the processor is further configured to:

determine a home model based at least in part on historical power consumption of the first and second HVAC systems and historical indoor temperatures achieved by the first and second HVAC systems, wherein the home model indicates anticipated indoor temperature as a function of run time of the first and second HVAC systems; and determine the staging scheduled based at least in part on the home model.

7. The system of claim 1, wherein each of the first HVAC system and the second HVAC system comprise a single stage compressor.

8. A method of operating a first heating, ventilation, and air conditioning (HVAC) system configured to regulate a first temperature of a first space based on a first temperature setpoint and a second HVAC system configured to regulate a second temperature of a second space based on a second temperature setpoint, the method comprising:

receiving a demand response request indicating an upper limit on combined power consumption by the first and second HVAC systems during a future period of time, wherein the second HVAC system is different from the first HVAC system;

determining, based on enrollment data, that both the first HVAC system and the second HVAC system are participating in an automatic demand response operation, the enrollment data indicating which HVAC systems are participating in the automatic demand response operation;

determine a first anticipated power consumption associated with operating the first HVAC system at the first temperature setpoint during the future period of time of the demand response request;

determining a second anticipated power consumption associated with operating the second HVAC system at the second temperature setpoint during the future period of time of the demand response request;

determining, based at least in part on the first anticipated power consumption and the second anticipated power consumption, a staging schedule indicating:

a first portion of the future period of time of the demand response request during which the first HVAC system is turned off and the second HVAC system is turned on, and a second portion of the future period of time of the demand response request during which the first HVAC system is turned on and the second HVAC system is turned off; and operating the first HVAC system and the second HVAC system according to the determined staging schedule.

9. The method of claim 8, further comprising:

determining a first occupancy of the first space;

determining a second occupancy of the second space;

determining, based on the first occupancy and the second occupancy, that the first space is unoccupied and the second space is occupied; and in response to determining that that the first space is unoccupied and the second space is occupied:

causing the first HVAC system to shut off during the future period of time of the demand response request; and adjusting the staging schedule to increase the first portion of the future period of time during which the second HVAC system is turned on.

10. The method of claim 9, wherein:

determining the first occupancy comprises measuring the first occupancy of the first space using a first occupancy sensor of the first HVAC system; and determining the second occupancy comprises measuring the second occupancy of the second space using a second occupancy sensor of the second HVAC system.

11. The method of claim 8, further comprising:

receiving a user input indicating that the first HVAC system is opted out of the automatic demand response;

after receiving the user input, adjust the staging schedule to:

removing the first portion of the future period of time during which the first HVAC system is turned off; and increasing the second portion of the future period of time during which the second HVAC system is turned off.

12. The method of claim 11, further comprising receiving the user input via a thermostat of the first HVAC system.

13. The method of claim 8, further comprising:

determining a home model based at least in part on historical power consumption of the first and second HVAC systems and historical indoor temperatures achieved by the first and second HVAC systems, wherein the home model indicates anticipated indoor temperature as a function of run time of the first and second HVAC systems; and determining the staging scheduled based at least in part on the home model.

14. The method of claim 8, wherein each of the first HVAC system and the second HVAC system comprise a single stage compressor.

15. Multiple-system controller, comprising: an interface communicatively coupled to:

a first heating, ventilation, and air conditioning (HVAC) system configured to regulate a first temperature of a first space based on a first temperature setpoint; and a second HVAC system configured to regulate a second temperature of a second space based on a second temperature setpoint, wherein the second HVAC system is different from the first HVAC system;

a memory configured to store enrollment data indicating which HVAC systems are participating in an automatic demand response operation; and a processor communicatively coupled to the interface and the memory, the processor configured to:

receive a demand response request indicating an upper limit on combined power consumption by the first and second HVAC systems during a future period of time;

determine, based on the enrollment data, that both the first HVAC system and the second HVAC system are participating in the automatic demand response operation;

determine a first anticipated power consumption associated with operating the first HVAC system at the first temperature setpoint during the future period of time of the demand response request;

determine a second anticipated power consumption associated with operating the second HVAC system at the second temperature setpoint during the future period of time of the demand response request;

determine, based at least in part on the first anticipated power consumption and the second anticipated power consumption, a staging schedule indicating:

a first portion of the future period of time of the demand response request during which the first HVAC system is turned off and the second HVAC system is turned on, and a second portion of the future period of time of the demand response request during which the first HVAC system is turned on and the second HVAC system is turned off; and operate the first HVAC system and the second HVAC system according to the determined staging schedule.

16. The multiple-system controller of claim 15, wherein the processor is further configured to:

determine a first occupancy of the first space;

determine a second occupancy of the second space;

determine, based on the first occupancy and the second occupancy, that the first space is unoccupied and the second space is occupied; and in response to determining that that the first space is unoccupied and the second space is occupied:

cause the first HVAC system to shut off during the future period of time of the demand response request; and adjust the staging schedule to increase the first portion of the future period of time during which the second HVAC system is turned on.

17. The multiple-system controller of claim 16, wherein:

the first HVAC system comprises a first occupancy sensor configured to detect the first occupancy of the first space; and the second HVAC system comprises a second occupancy sensor configured to detect the second occupancy of the second space.

18. The multiple-system controller of claim 15, wherein the processor is further configured to:

receive a user input indicating that the first HVAC system is opted out of the automatic demand response;

after receiving the user input, adjust the staging schedule to:

remove the first portion of the future period of time during which the first HVAC system is turned off; and increase the second portion of the future period of time during which the second HVAC system is turned off.

19. The multiple-system controller of claim 18, wherein the first HVAC system comprises a first thermostat configured to:

receive the user input; and transmit the user input to the multiple-system controller.

20. The multiple-system controller of claim 15, wherein the processor is further configured to:

determine a home model based at least in part on historical power consumption of the first and second HVAC systems and historical indoor temperatures achieved by the first and second HVAC systems, wherein the home model indicates anticipated indoor temperature as a function of run time of the first and second HVAC systems; and determine the staging scheduled based at least in part on the home model.

* * * * *